United States Patent [19]

Cole

[11] Patent Number: 4,564,114

[45] Date of Patent: Jan. 14, 1986

[54] MOLDED SAFETY CLOSURE DEVICE

[75] Inventor: Harold E. Cole, Magalia, Calif.

[73] Assignee: James R. Goldberg, Novato, Calif.

[21] Appl. No.: 684,810

[22] Filed: Dec. 21, 1984

[51] Int. Cl.[4] ..... B65D 41/48

[52] U.S. Cl. ..... 215/256; 215/306

[58] Field of Search ..... 215/256, 306

[56] References Cited

U.S. PATENT DOCUMENTS

| | | | |
|---|---|---|---|
| 773,345 | 10/1904 | Scheidt | 215/306 |
| 1,265,263 | 5/1918 | Sharpe | 215/306 |
| 3,235,117 | 2/1966 | Mason, Jr. | 215/306 |
| 3,904,062 | 9/1975 | Grussen | 215/252 |
| 3,994,409 | 11/1976 | Nightengale | 215/306 X |
| 4,429,799 | 2/1984 | Zaltsman | 215/306 X |
| 4,474,302 | 10/1984 | Goldberg | 215/256 |

*Primary Examiner*—Donald F. Norton

*Attorney, Agent, or Firm*—Fitch, Even, Tabin & Flannery

[57] ABSTRACT

A safety closure device for a bottle or the like is described. The device includes a cylindrical closure element which fits within the mouth of the bottle and which is restrained from flying free of the bottle by a cylindrical retainer collar which fits around the neck of the bottle. The closure element is attached to the collar by a tether strip which is molded integrally with the closure element and the collar and which tears free thereof, except for attachment to the collar and closure element at the ends of the tether. The tether is folded upon itself and when manually torn free, and is long enough to permit the closure element to be withdrawn from the bottle while still remaining tethered to the collar.

5 Claims, 4 Drawing Figures

FIG. 1
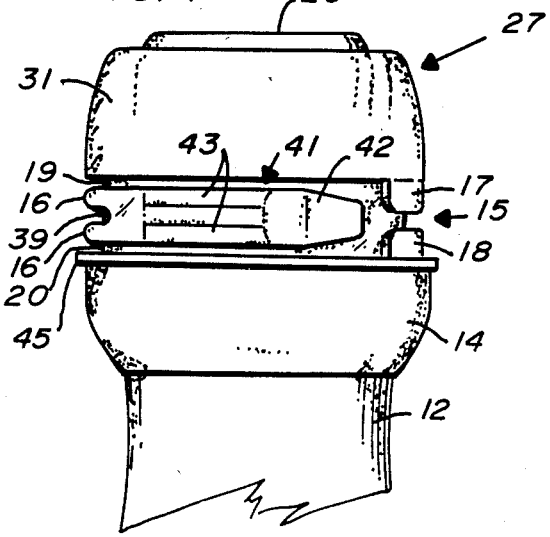
FIG. 4
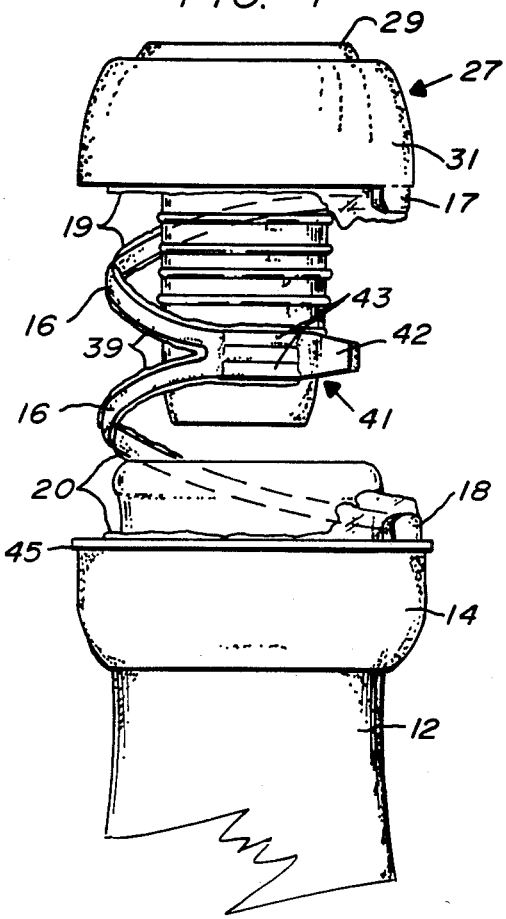
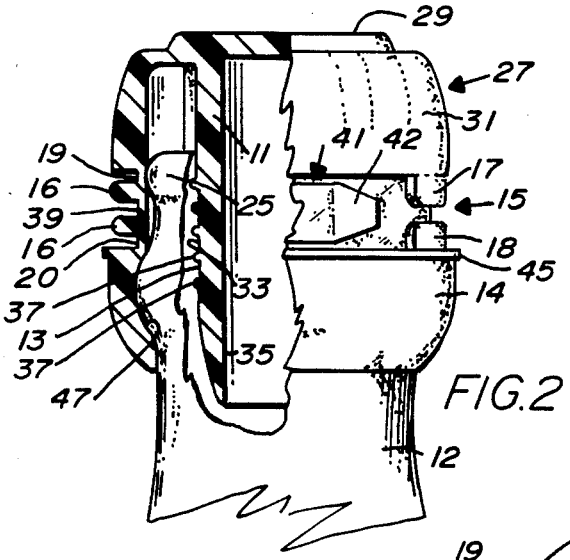
FIG.2
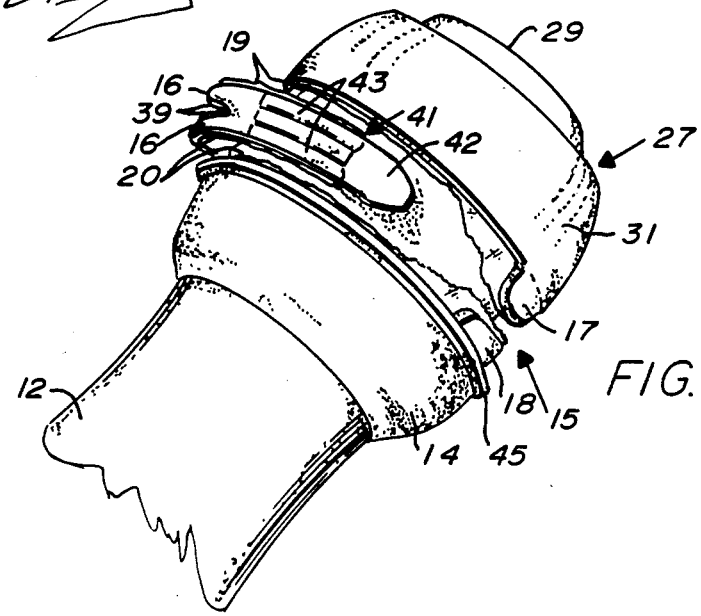
FIG. 3

MOLDED SAFETY CLOSURE DEVICE

This invention relates generally to closure devices and, more specifically, to a safety closure device for use on bottles containing pressurized beverages such as champagne or sparkling wines.

The drinking of champagne or sparkling wine is usually associated with happiness and frivolity. Unfortunately the happiness and frivolity has all too often ended in tragedy because of injuries caused by flying corks. Because of pressure inside a bottle of champagne or sparkling wine, particularly if the wine has been shaken or is warmer than recommended, a cork can be propelled from the bottle at a velocity of well over 120 kph. As a consequence, unattentive individuals opening the bottle, or persons standing nearby, can be seriously injured.

The problem of premature or inadvertent explosive release of champagne corks is exacerbated by the fact that many lower priced champagnes and sparkling wines are closed by molded plastic corks. Plastic corks possess an even greater tendency than natural corks to become dislodged as a result of internal pressure in the bottle. In addition, the slipperiness of plastic is sometimes increased when the cork is molded because of a residue of the release agents often used to facilitate removal of a hot plastic cork from the mold in which it is made. Wetness on the glass surface of the bottle as a result of condensation or seepage of the contents can also reduce friction between the surface of the glass and the surface of the plastic cork.

An improved closure device for a bottle or the like which is particularly well suited for use in connection with champagne and sparkling wines is shown and described in U.S. Pat. No. 4,474,302. The device shown and described therein employs a tabbed tear strip and a tether strip that are integrally formed in an intercoupling section which joins the cap of the cork to a retaining collar which fits over the neck of the bottle. When the tear strip is torn away, a helical tether strip remains interconnecting the plug or cork and the retainer collar. The cork or plug may thus be easily released from the bottle but is restrained from flying free.

The foregoing device provides a significant improvement in closures for bottles and other containers containing pressurized liquids such as champagne or sparkling wines. The need for additional restraining devices such as wire baskets, shrink wraps, or the like is eliminated. Moreover, it is unnecessary for the person opening the bottle to manually restrain the champagne cork as it is being removed from the bottle.

It may be undesirable, in the closure device of the foregoing described patent, that a small plastic tear strip is separated from the remainder of the device when the device is opened. These small pieces of plastic are easily overlooked and represent a potential source of litter. Another problem which may exist under some circumstances with the design of the aforementioned patent is that, due to the relatively small cross section of the tear strip, some persons may find the strip difficult to grasp in order to begin the tearing process to free the tether strip. Finally, since the tear strip itself does not contribute to retaining the cork or plug upon opening, it is in effect wasted plastic which is inefficiently employed from a materials standpoint.

It is an object of the present invention to provide an improved safety closure device for use on bottles containing pressurized beverages such as champagne or sparkling wines.

Another object of the invention is to provide an improved safety closure device for use on bottles containing pressurized beverages wherein a tether strip is formed by manual tearing and wherein the need for a separate tear strip to free the tether strip is eliminated.

It is another object of the invention to provide an improved tether strip type closure device for use on bottles containing pressurized beverages wherein the most efficient use of material is achieved.

Other objects of the invention will become apparent to those skilled in the art from the following description, taken in connection with the accompanying drawings wherein:

FIG. 1 is an elevational view illustrating the closure device of the invention in place on a bottle;

FIG. 2 is a view identical to FIG. 1 with part of the device broken away to show the interior construction thereof;

FIG. 3 is perspective view of the device of the invention in place on a bottle after separation of the tether strip; and FIG. 4 is an elevational view illustrating the device after separation of the tether strip and removal of the plug.

Very generally, the safety device of the invention comprises a cylindrical closure element 11 adapted to close the mouth of a bottle 12 or the like by frictional engagement with the interior facing surface 13 of the mouth of the bottle. A cylindrical retainer collar 14 fits on the neck of the bottle and is coupled to the closure element by an intercoupling section 15 such that the closure element and the collar extend substantially coaxially with each other. The intercoupling section includes a tabbed tether strip 16 which is integrally formed with and secured at its respective ends 17, 18 to the closure element and the collar. The tether strip is joined to the closure element and the collar along a preselected length of the tether strip by frangible webs 19, 20 of a preselected thickness to permit the tether strip to be manually separated from the closure element and the collar along the preselected length. The tether strip is folded upon itself at least once and is of a length unfolded such that the closure element may be removed from the bottle or the like but is restrained by the collar from flying free of the bottle.

The closure device of the present invention is illustrated in FIGS. 1 through 4. The safety closure device is shown mounted on the neck of a bottle 12 designed to hold pressurized liquids such as champagne or other sparkling wines. The device of the invention includes a cylindrical closure element or plug 11 and a retainer collar 14 both interconnected by an intercoupling section 15.

The bottle 12 in FIGS. 1 and 2 is typical of bottles used to contain champagne and sparkling wines. Such bottles often have elongated, tapered, cylindrical necks containing a circumferential bulge or ridge 34 (known to the trade as a "finishing or bead ring") just below a lip 25 at the top of the bottle. The circumferential ridge 23 protrudes from the side of the bottle with sufficient radius to provide a means for restraining or impeding objects or devices, fastened above or below it, from moving up or down the neck of the bottle. In the past, such objects and devices have included, for example, woven wire baskets used to restrain plugs or corks. In the present invention, the circumferential ridge 23 is used to restrain the retainer collar 14.

The closure device of the invention is, preferably, formed of a molded unitary piece of a suitable resilient substance. While polymerized plastic is a preferable resilient substance, other resilient substances are suitable as long as they are weak in shear when thin but strong in tension when thick. As used herein, "weak in shear when thin" means a substance that is manually tearable when used at the preselected thickness of the thin frangible webs 19 and 20 connecting the tether strip to the closure element and the collar. "Strong in tension when thick" means that, at the thickness of the tether strip, the substance is strong enough to withstand longitudinal strain caused by sudden release of the cork from the bottle.

For purposes of this invention, a suitable resilient substance will be moldable. A suitable resilient substance will also have sufficient resiliency to allow the retainer collar 14 to stretch but not break as it is inserted over the neck of the bottle, including the circumferential ridge 23. Following the expansion necessary to allow the tapered retainer collar 14 to pass over the circumferential ridge 33, a suitable material will still have sufficient resiliency to allow the collar to assume a shape that conforms generally to the contour of the outside of the bottle.

The closure element 11 includes a cap 27 of generally cup-like shape. The cap 27 is comprised of a circular disk-like top portion 29 integrally molded with a hollow cylindrical side portion 31. The diameter of the cap's circular top portion 29 is greater than the diameter of the opening in the top of the bottle at the lip 25. (FIG. 2) The inner circumference of the cap's hollow cylindrical side portion is slightly greater than the outer circumference of the lip 29 at the top of bottle.

The cork or closure element 11 is preferably hollow having an outer cylindrical wall surface 33 (FIG. 2) and an inner cylindrical wall surface 35. The cylindrical closure element 11 has an outer diameter at the surface 33 very slightly smaller than the diameters of the opening at the top of the bottle and the upper inner portions of the bottle neck. This allows the closure element to fit tightly down into the neck of the bottle. About halfway down the length of the closure element 11, a series of parallel annular ridges 37 protrude slightly from the outer wall surface 33. The width and height of the annular ridges are approximately equal. The annular ridges extend down the outer wall surface 33 of the plug to a point approximately in line with the bottle's circumferential ridge 23 when the closure device is in place in the bottle 12. When in place, the circumferential wall 33 of the closure element 11 supports the annular ridges 37 against the inner wall of the bottle neck. As a result, the annular ridges grasp against the inner surface of the bottle helping to seal its contents.

The closure element 11 is adapted to close the mouth of the bottle by frictional engagement with the interior facing surface of the mouth. The intercoupling section 15 couples the collar 14 to a cap 27 of the closure element 11. The intercoupling section 15 is comprised of the tabbed tether strip 16 formed integrally in the intercoupling section. One end 17 of the tether strip is secured to the cap 27 and the other end 18 is secured to the collar 14. The tether strip 16 is folded once on itself and the two portions are interconnected by a grooved frangible web 39. The thickness and configuration of the frangible web 39 are preselected to be less than the thickness of the tether strip. The tether strip 16 contains an integral pull tab portion 41 at its fold which provides an easy and convenient means for grasping the tether strip 16 prior to its separation as described below.

A tab 42 on the tab portion 41 of the tether strip 28 may be suitably roughened, not shown, to help prevent the tab from slipping when grasped by a person wishing to separate the tether strip from the closure device. A plurality of parallel ribs 43 extend along the tab portion 41, the tab portion being thickened so as to be non-frangible from the free tip of the tab 42 to the end of the frangible web 39 at the fold of the tether strip 16. (See FIG. 4)

The retainer collar 14 is comprised of a hollow cylinder that fits around the top outside portion of the bottle neck. The interior shape of the retainer collar 14 generally mirrors the contour of the outer surfaces of the champagne or sparkling wine bottle 12. At the lower end of the intercoupling section 15, a small circumferential ridge 45 is provided that protrudes from the outer surface of the collar 14. Just below ridge 45, on the inner surface of the collar, the collar contains a circumferential groove or annular recess 47. (FIG. 2) The shape and size of the recess 47 generally mirrors and approximates the shape and size of circumferential ridge 23 on the outer surface of the champagne or sparkling wine bottle. When the tethered safety closure device 10 is installed on a champagne or sparkling wine bottle, the collar's annular recess 47 fits around the circumferential ridge 23 on the neck of the bottle, holding the collar in place. Security of the collar on the bottle neck is assured by providing sufficient thickness in the wall of the collar below the recess 47 to prevent circumferential expansion and consequent upward movement of the collar 14 as a result of pressure in the bottle.

The tether strip 16 is folded upon itself a single time in the illustrated embodiment and is of a length unfolded such that the closure element or plug 11 may be removed from the bottle. However, the length of the tether strip unfolded is such as to restrain the capped closure element 11 from flying free of the bottle with the attendant possibility of injury. Preferably, the length of the tether strip 16 is between 6 centimeters and 10 centimeters.

The tether strip 16 is interconnected with the cap 27 of the closure element 11 by the frangible web section 19 and is connected to the collar 14 by a frangible web 20. The webs 19 and 20 are of a thickness and configuration preselected to be less than the thickness of the tether strip for reasons explained below.

When the pull tab portion 41 of the tether strip 16 is grasped and pulled by one wishing to open a bottle of sparkling wine, the tether strip 16 separates from the cap 27 and the collar 14 because of a tearing of the frangible web sections 19 and 20 along the path of the grooves. When the tether strip 16 is separated, it still remains to interconnect the closure element 11 and the collar 14 thus enabling the closure element to be released from the bottle 12 without flying free. The energy of the closure element 11 is further absorbed by the tearing of the web 39 between the folds of the tether strip 16 as the tether strip unfolds.

The webs 19, 20 and 39 may be continuous, or may be broken by a series of openings, not shown, which facilitate separation of the tether strip. The strength of the webs is selected, however, to provide sufficient strength to maintain a cohesive structure until separation of the tether strip. The tether strip 16 is separable by manually causing the webs to tear. Following removal of the tether strip 16, as shown in FIG. 4, the tether strip 16 remains attached to the cap 27 of the closure element 11 and to the collar 14. This may be accomplished by means of a merging brought about by a gradual diminution of the depth of the groove separating the cap or collar material from the ends of the tether turns into the termini regions 17 and 18.

In addition to providing the means for connecting the cap 27 to the retainer collar 14, the intercoupling section 18 creates an integral tamper proof safety seal between the cap 27 and the collar 14 because it unmistakably indicates by dismemberment if the product has been prematurely opened or tampered with anywhere between the bottler's facilities and the end user's location.

Because of the design of the tethered safety closure device and the material used to construct it, the unitary tethered safety closure device of the present invention can easily be inserted on bottles containing champagne or sparkling wine. The thickness at the bottom of the retaining collar is selected to facilitate placing the device on the wine bottle. The resiliency of the material used to make the tethered safety closure device allows it to expand and contract as necessary to fit securely in and around the neck of the bottle. This resiliency can be increased with heat if the properties of the material so warrant.

Various modifications of the invention in addition to those shown and described herein will become apparent to those skilled in the art from the foregoing description and accompanying drawings. Such modifications are intended to fall within the scope of the appended claims.

What is claimed is:

1. A safety closure device comprising a closure element adapted to close the mouth of a bottle or the like by frictional engagement with the interior facing surface of the mouth, a retainer collar, and an intercoupling means connecting said collar to said closure element with said closure element and said collar extending substantially coaxially with each other, said intercoupling means comprising a tabbed tether strip, said tether strip being integrally formed with and secured at its respective ends to said closure element and said collar, said tether strip being joined to said closure element and said collar along a preselected length of said tether strip by frangible webs of a preselected thickness to permit said tether strip to be manually separated from said closure element and said collar along said preselected length, said tether strip being folded upon itself at least once and being of a length unfolded such that said closure element may be removed from the bottle or the like but is restrained by said collar and said tether strip from flying free.

2. A safety closure device according to claim 1 wherein said folded configuration of said tether strip is a single fold.

3. A safety closure device according to claim 1 wherein the folded segments of said tether strip are joined to each other along their length by a frangible web which absorbs energy when said tether strip is unfolded.

4. A safety closure device according to claim 1 wherein said tether strip extends circumferentially about said safety closure device between said closure element and said collar.

5. A safety closure device according to claim 4 wherein said tether strip extends in a single turn.

* * * * *